US007513050B2

(12) United States Patent
Kroening, Jr.

(10) Patent No.: US 7,513,050 B2
(45) Date of Patent: Apr. 7, 2009

(54) DIGITAL ARCHERY SIGHT

(75) Inventor: John W. Kroening, Jr., New Berlin, WI (US)

(73) Assignee: Superior Design, Inc., Waukesha, WI (US)

( * ) Notice: Subject to any disclaimer, the term of this patent is extended or adjusted under 35 U.S.C. 154(b) by 22 days.

(21) Appl. No.: 11/752,706

(22) Filed: May 23, 2007

(65) Prior Publication Data

US 2008/0289201 A1 Nov. 27, 2008

(51) Int. Cl.
*F41G 1/467* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS

| | | | | | |
|---|---|---|---|---|---|
| 3,487,548 | A | * | 1/1970 | Frydenlund | 33/265 |
| 3,574,944 | A | | 4/1971 | Reynolds | |
| 3,674,002 | A | * | 7/1972 | Diamond, Sr. | 124/87 |
| 3,822,479 | A | | 7/1974 | Kowalski | |
| 4,020,560 | A | | 5/1977 | Heck | |
| 4,543,728 | A | | 10/1985 | Kowalski | |
| 4,584,777 | A | | 4/1986 | Saunders | |
| 4,617,741 | A | * | 10/1986 | Bordeaux et al. | 33/228 |
| 5,092,052 | A | * | 3/1992 | Godsey | 33/265 |
| 5,174,269 | A | | 12/1992 | Sappington | |
| 5,465,491 | A | * | 11/1995 | Thell | 33/265 |
| 5,575,072 | A | * | 11/1996 | Eldridge | 33/265 |
| 5,651,185 | A | * | 7/1997 | Vanderheyden et al. | 33/265 |
| 5,718,215 | A | * | 2/1998 | Kenny et al. | 124/87 |
| RE36,266 | E | | 8/1999 | Gibbs | |
| 5,941,226 | A | | 8/1999 | Marietta | |
| 6,079,111 | A | * | 6/2000 | Williams et al. | 33/265 |
| 6,119,672 | A | * | 9/2000 | Closson | 124/87 |
| 6,430,822 | B1 | * | 8/2002 | Slates | 33/265 |
| 6,505,407 | B2 | * | 1/2003 | Savage | 33/265 |
| 6,609,306 | B2 | * | 8/2003 | Johnson et al. | 33/265 |

* cited by examiner

*Primary Examiner*—Christopher W Fulton
(74) *Attorney, Agent, or Firm*—Boyle Fredrickson S.C.

(57) ABSTRACT

A bow sight that includes a body, a stator, a slide, and an electronic sight position indicator. The body is constructed to secure the sight to a bow and the stator and slide are attached to the body such as to allow relative motion between the stator and the slide. The position indicator is attached to the bow sight and electronically determines the relative position of the stator and the slide and thereby provides an indication of an orientation of an eyepiece relative to the bow.

4 Claims, 5 Drawing Sheets

DIGITAL ARCHERY SIGHT

FIELD OF THE INVENTION

The present invention relates to bows, and more specifically to a bow sight constructed to electronically assess and/or indicate the position of the sight relative to the bow.

BACKGROUND OF THE INVENTION

Archery bow sights generally include one or more movable pins that are secured to a support structure. The support structure is constructed to be attached to a bow. The sight is mounted to a bow so that when the bow string is drawn, the archer can look through the sight and align a pin or tip of a sight pin with a target. Regardless of the number of sight pins, for an archer to accurately utilize the sight, the sight must first be "sighted-in" or have the position of the pins associated with the trajectory of an arrow for given shooting conditions. Commonly, sighting-in a bow requires that an archer sequentially fire a number of arrows under normal conditions and yardages while incrementally adjusting the orientation of the sight pin relative to the bow. For sights equipped with a number of sight pins, this can be a time-consuming and tedious process.

The performance of bow sights equipped with a single sight pin also relies on the ability of the archer to return the sight pin to any number of predetermined positions. During the sighting-in process, the archer adjusts the position of the sight pin relative to the supporting structure for an archer's relative position or distance to an intended target. Frequently, the position of the sight is associated with a distance, or yardage, of the archer from the target. Many archers select predefined yardages such as 10, 20, 30, and 40 yards as the preset values for the sight pin or pins. Understandably, depending on the complexity of the indexing system associated with the predefined yardages, a sight could be provided with a number of yardage indicators. Additionally, rather than being generally even distance values, the yardages could also be tailored to an archer's personal preferences. These random yardage or distance values are commonly associated with shooting conditions such as the distance from a stand to a bait location or stationary target.

Particularly for the sights equipped with a single variable position sight pin, the ability of the sight to index the position of the pin relative to the bow is an important consideration for an archer shooting under various conditions. Particularly in target shooting as compared to game shooting, an archer may be required to perform shots at various yardages over a relatively short duration. Such target shooting occasionally requires the archer to shoot a first target at a first yardage, shoot a second target at another yardage, and then shoot a third target more proximate to the first yardage. Accordingly, it is desired to provide a bow sight with good repeatability characteristics as to the position of the sight pin relative to a preset sight pin orientation.

Regardless of the number of predefined yardages and the yardage values associated with the predefined pin positions, the archer's performance also relies on the archer's ability to estimate the distance to a target. As an example, an archer calibrates a sight position at 20 yards from target. During shooting, the archer overlays the site pin with the intended destination of the arrow. Provided the conditions are nearly identical to the conditions during which the archer set the sight pin, the arrow should hit the target in the intended area.

If however, the archer is at a location 23 yards from the target, the archer must estimate the position of the sight pin on the target such that the arrow strikes the intended target zone. Otherwise, sighting the target with the 20 yard sight pin would result in a strike below the desired impact or target area. Understandably, this sight estimation process can detrimentally effect the accuracy of the archer. Accordingly, it is also desired to provide an archery sight that accommodates various shooting distances aside from the one or more preset sight pin reference positions.

SUMMARY OF THE INVENTION

The present invention provides an archery sight that overcomes the aforementioned drawbacks. An archery sight according to one aspect of the invention includes a body constructed to be secured to a bow and a stator, slide, and yardage indicator attached to the body. The stator and slide are attached to the body such as to allow relative motion between the stator and the slide. The yardage indicator is attached to the bow sight and electronically determines the relative position of the stator and the slide and thereby providing an indication of an orientation of a sight pin, scope, or eyepiece relative to the bow.

Another aspect of the invention discloses an archery sight that includes a body, an ocular, an adjustment mechanism and a digital display. The body is constructed for engaging a bow, and the ocular is constructed for being disposed between an archer and a target. The adjustment mechanism adjusts a position of the ocular relative to the body. The digital display outputs an indication of a distance between the archer and the target. The archery sight provides a sighting system that is accurate and repeatable.

A bow sight, according to another aspect of the invention, includes an eyepiece that is movably attached to a support body. A positioning system is configured to electronically determine the position of the eyepiece relative to the support body.

A method of providing an archery sight according to a further aspect of the invention provides a body that is constructed to be secured to a bow. An operator is provided that is attachable to the body such that the operator is movable relative to the body. The method further includes electronically determining a relative position of the operator and the body. Such a construction provides a method of forming a bow sight wherein the sight can be quickly, accurately, and repeatably be configured for shooting at various yardages.

Yet another aspect of the invention discloses an archery sight that includes a number of interconnected members. A first member is constructed for being attached to a bow. A second member is pivotably attached to the first member. A third member is pivotably attached to the second member remote from the first member. A scope ring is attached to the third member. A fourth member is pivotably attached to both the first member and the third member and offset from the second member. Such a construction provides an archery sight having a plurality of connected members constructed to maintain the scope ring in an orientation generally normal to a shooting line-of-sight.

Numerous other aspects and features of the present invention will be apparent from the following detailed description and drawing figures.

BRIEF DESCRIPTION OF THE DRAWINGS

The drawings illustrate the best mode currently contemplated as practicing the present invention.

In the drawings.

DETAILED DESCRIPTION OF THE INVENTION

Figure 1:
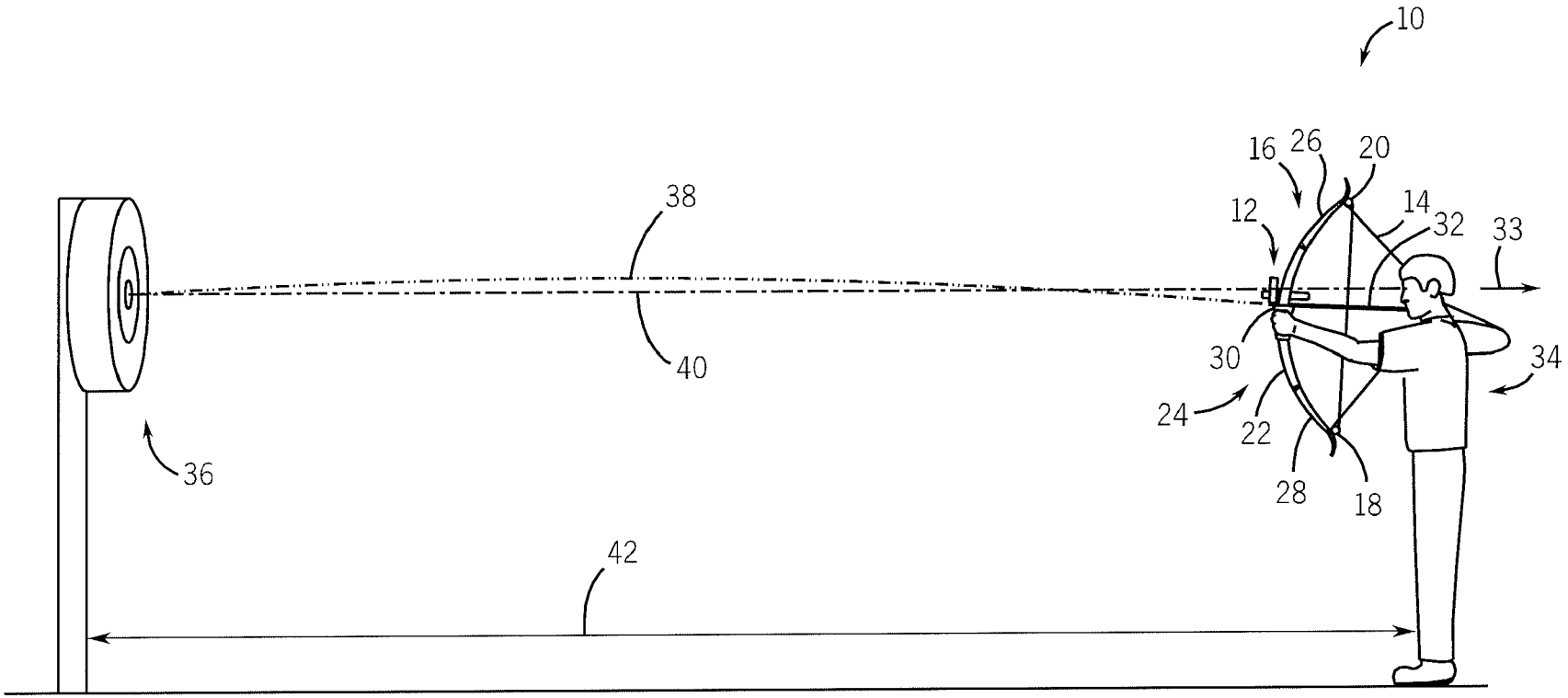
FIG. 1 is an elevation view of a target and an archer having a bow equipped with a sight according to one embodiment of the present invention.

FIG. 1 shows a bow 10 equipped with a sight 12 according to the present invention. Bow 10 includes a drawstring 14 attached to a frame assembly 16 by a number of pulleys or cams 18, 20. Frame assembly 16 includes a riser 22 having a grip portion 24 and an upper limb 26 and a lower limb 28 attached thereto. As commonly understood such a construction forms an exemplary compound bow although the present invention is applicable with a number of the bow constructions such as recurve or longbows. A rest 30 is attached to riser 22 and is constructed to support an arrow 32 thereon. As an archer 34 pulls drawstring 14, arrow 32 translates rearward, indicated by arrow 33, relative to riser 22. Nocking a butt of arrow 32 in drawstring 14 ensures that arrow 32 is propelled, fired, or shot toward a target 36 when archer 34 releases a drawstring 14. Arrow 32 follows a projectile trajectory path 38 whereas the aim of archer 34 follows a substantially more linear path or a sight path 40. Sight 12 is constructed such that projectile path 38 and sight path 40 are substantially coterminous at target 36 for a variety of distances, indicated by line 42, between archer 34 and target 36.

Figure 2:
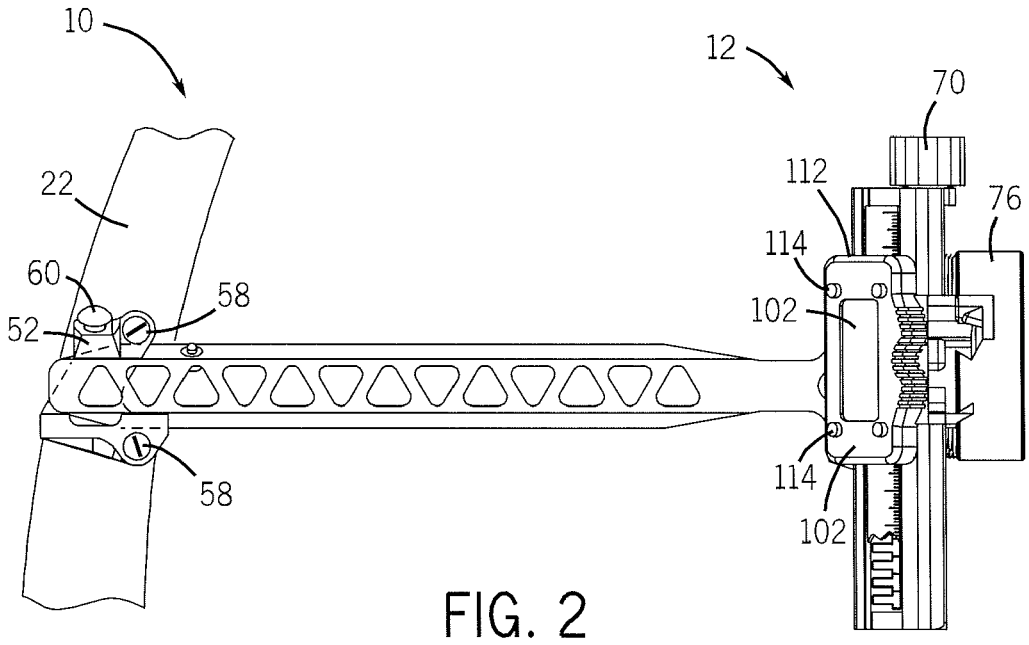
FIG. 2 is an elevation view of the bow sight shown in FIG. 1.
Figure 3:
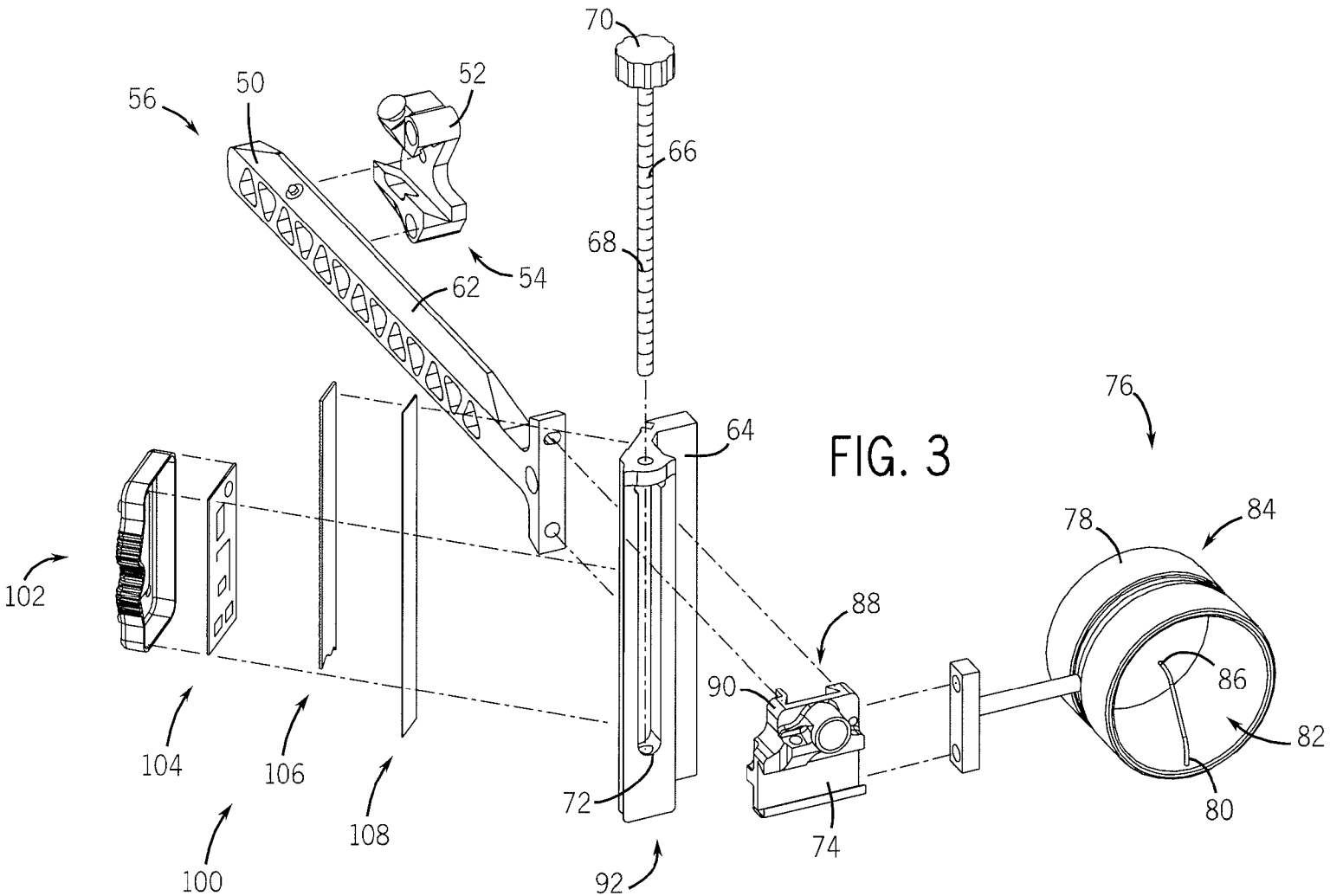
FIG. 3 is an exploded view of the bow sight shown in FIG. 2.

As shown in FIGS. 2 and 3, sight 12 includes a body 50 constructed to be secured to riser 22 of bow 10. An adapter 52 has a contour 54 that is constructed to generally match a contour 56 of body 50. A number of fasteners 58 pass through adapter 52 and are constructed to operationally engage riser 22 such adapter 52 secures body 50 to riser 22. A position pin 60 passes through adapter 52 and is constructed to engage body 50 to secure a position of body 50 relative to riser 22 of bow 10. As shown in FIG. 3, body 50 includes a horizontal portion 62 and a vertical portion 64 that are constructed to be secured to one another. Understandably, horizontal portion 62 and vertical portion 64 could be formed as a one piece element.

An indexing pin 66 is constructed to be connected to vertical portion 64 of body 50. Indexing pin 66 includes a stem portion 68 and a head portion 70. Preferably, indexing pin 66 is a threaded pin. Stem portion 68 is constructed to pass through an opening 72 formed in vertical portion 64. Stem portion 68 operatively engages a carriage 74 that is constructed to support an ocular, scope ring, sight ring, or eyepiece 76. Preferably, eyepiece 76 includes a body 78 having a generally circular shape. A pin or sight pin 80 passes into an area 82 generally enclosed by body 78. Preferably, sight pin 80 is constructed of a fiber-optic material which passes through body 78 and includes a portion 84 that is wound generally about body 78. Such a construction allows sight pin 80 to collect ambient illumination thereby increasing the light intensity associated with a tip 86 of sight pin 80. Understandably, this is merely an exemplary sight pin and sight pin 80 could have any of a number of constructions including being formed of a solid material or being a self-powered lighted sight for example.

A channel 88 is formed along a surface 90 of carriage 74 and is configured to generally cooperate with a contour 92 formed along the length of vertical portion 64 of body 50. Such a construction allows carriage 74 to translate along the length of vertical portion 64 of body 50 upon manipulation of indexing pin 66 by archer 34. Such a construction allows eyepiece 76 to translate relative to body 50 of sight 12 during operation of indexing pin 66. Such operation of indexing pin 66 also translates eyepiece 76 relative to riser 22 of bow 10.

Sight 12 includes a positioning system 100 that includes a display 102, a controller 104, a slide 106, and a stator 108. Positioning system 100 is constructed to be supported by body 50. Controller 104 is constructed to interface with slide 106 and stator 108 such as to reference and indicate a position of slide 106 relative to stator 108. It is appreciated that the operation of slide 106 and stator 108 could be provided in any of a number of forms. That is, the stator and slide may be associated as an electrical circuit and an electromagnetic material wherein passage of one past the other affects a detectable electrical parameter of one or both the electrical circuit and the electromagnetic material. In such a construction it is envisioned that one or both the stator and slide is constructed as an electrode having a pattern fabricated of a layer of copper and/or a glass epoxy laminate material. A protective layer could be provided over the pattern of the electrode to maintain the integrity of the pattern. A capacitive sensor would monitor the relative position of the slide and stator via alterations in the electrical parameters between the respective moveable parts. Alternatively, the stator and slide may be configured as a laser transmitter and receiver or reflector wherein motion of one relative to the other can be detected and monitored. The stator and slide may also be configured as an acoustic wave emitter and receiver or reflector. Understandably, these are only examples of the modalities that can be utilized for the detection of relative movement of slide 106 and stator 108. Regardless of the modality of the positioning system, the positioning systems disclosed herein are constructed to electronically determine the change in position of an eyepiece 76 of a sight relative to bow 10.

Translation of slide 106 relative to stator 108 is electronically detected by controller 104 and communicated to archer 34 via a display 102. Preferably, display 102 is a digital display. As shown in FIG. 2, positioning system 100 includes a cover 112 constructed to be positioned about controller 104. A number of operators or inputs 114 are connected to controller 104 and configured to allow archer 34 to interact with controller 104. Such a construction allows archer 34 to calibrate or preset a number of desired yardages or distances. During sighting-in of sight 12, archer 34, firing arrows at a target from distance 42, adjusts the position of eyepiece 76 until tip 86 of sight pin 80 is coterminous with the impact of arrow 32 at target 36. Archer 34 then interacts with controller 104 via inputs 114 to associate a position of slide 106 relative to stator 108 with distance 42. Such a construction allows archer 34 to calibrate sight 12 for desired shooting conditions and distances. Additionally, each time the slide 106 and stator 108 return to the preset relative positions, the electronic operation of sight 12 provides a high degree of repeatability with respect to adjusting the sight between various shooting distances 42.

It is further envisioned that controller 104 have a preset or "home" position wherein when archer 34 returns positioning system 100 to the preset position, controller 104 re-establishes a number of user defined positions with respect to the physical location of slide 106 and stator 108. Furthermore, it is envisioned that controller 104 monitor a duration between relative movements of slide 106 and stator 108 or be equipped with a timer such that controller 104 is turned 'OFF' during periods of inactivity to conserve on battery power. It is also envisioned that controller 104 will turn 'ON' automatically upon relative movement between slide 106 and stator 108. It is appreciated that controller 104 include a storage feature or database such that positioning system 100 will retain information associated with preset yardage values in the event a battery power source expires or otherwise is removed from positioning system 100.

Optionally, controller 104 includes a processor configured to estimate distance 42 from a number of preset distances 42. For example, if archer 34 calibrates sight 12 with respective shooting distances 42 of 20 and 30 yards, controller 104 may be configured to mathematically estimate the position of slide 106 relative to stator 108 for positions proximate the calibrated yardages. More preferably, controller 104 is configured to derive shooting distances from a single calibrated distance. Such a construction would allow archer 34 to shoot at various distances from a single calibrated a single distance 42. As archer 34 manipulates the position of slide 106 relative to stator 108 away from the preset position, controller 104 determines distance 42 from projectile geometry and communicates an estimated distance to archer 34 via display 102.

Display 102 is constructed to output an indication of the position of the eyepiece 76 relative to riser 22 in the form of a parameter associated with distance 42. Preferably, display 102 generates a digital output to provide an indication of the position of an eyepiece 76. That is, display 102 could display a numeral or letter associated with a preset distance or a value associated with the desired distance. If displaying the distance, it is further appreciated that display 102 and controller 104 provide distance values in one or more of a number of desired units such as feet, meters, yards, etc. Alternatively, display 102 could be constructed to provide for a number of output modalities including acoustic or other optical outputs such as LED or LCD signals.

Figure 4:
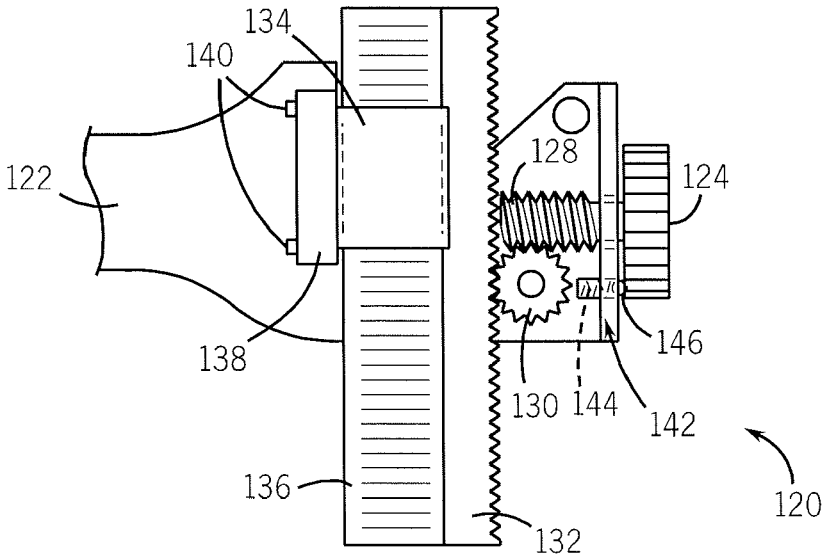
FIG. 4 is an elevation view of an alternate adjustment system of the bow sight shown in FIG. 3.

FIG. 4 shows an alternate embodiment of a positioning system 120 according to the present invention. A support arm 122 is constructed to extend between positioning system 120 and riser 22. Positioning system 120 includes an operator 124 having a handle portion 126 and a threaded portion 128. Handle portion 126 is constructed to be manipulated by archer 34. Threaded portion 128 is constructed to mesh with a first gear or pinion gear 130 which is operationally associated with a second gear or rack 132. Manipulation of operator 124 rotates pinion gear 130 thereby translating rack 132 relative to support arm 122.

A controller 134 includes a circuit configured to monitor the relative position of controller 134 and a stator 136. A display 138 is connected to controller 134 and configured to communicate to archer 34 the orientation of an eyepiece 76 relative to support arm 122. Display 138 includes a number of inputs 140 constructed to allow archer 34 to interface with controller 134 to configure positioning system 120 to orientate eyepiece 76 relative to support arm 122.

In addition to display 138, positioning system 120 includes a tactile reference indicator 142. Reference indicator 142 includes a spring 144 and an impactor 146 configured to engage handle portion 126 of operator 124. Such a construction provides archer 34 with a tactile indication of the degree of manipulation of operator 124. Preferably, threaded portion 128 and pinion gear 130 are oriented in a worm drive configuration thereby providing a more uniform translation of rack 132 upon manipulation of operator 124. Pinion gear 130 is attached to positioning system 120 and includes a course and/or a fine thread surface configured to mesh with a corresponding coarse and/or fine thread of rack 132 and threaded portion 128 of operator 124. Such a construction provides positioning system 120 with a course and a fine adjustment protocol. Preferably, support arm 122 and body 50 are constructed from a carbon fiber material thereby providing a sight that is both lightweight and durable. Understandably, these components could be constructed of a variety of materials such as aluminum based materials or the like.

Figure 5:
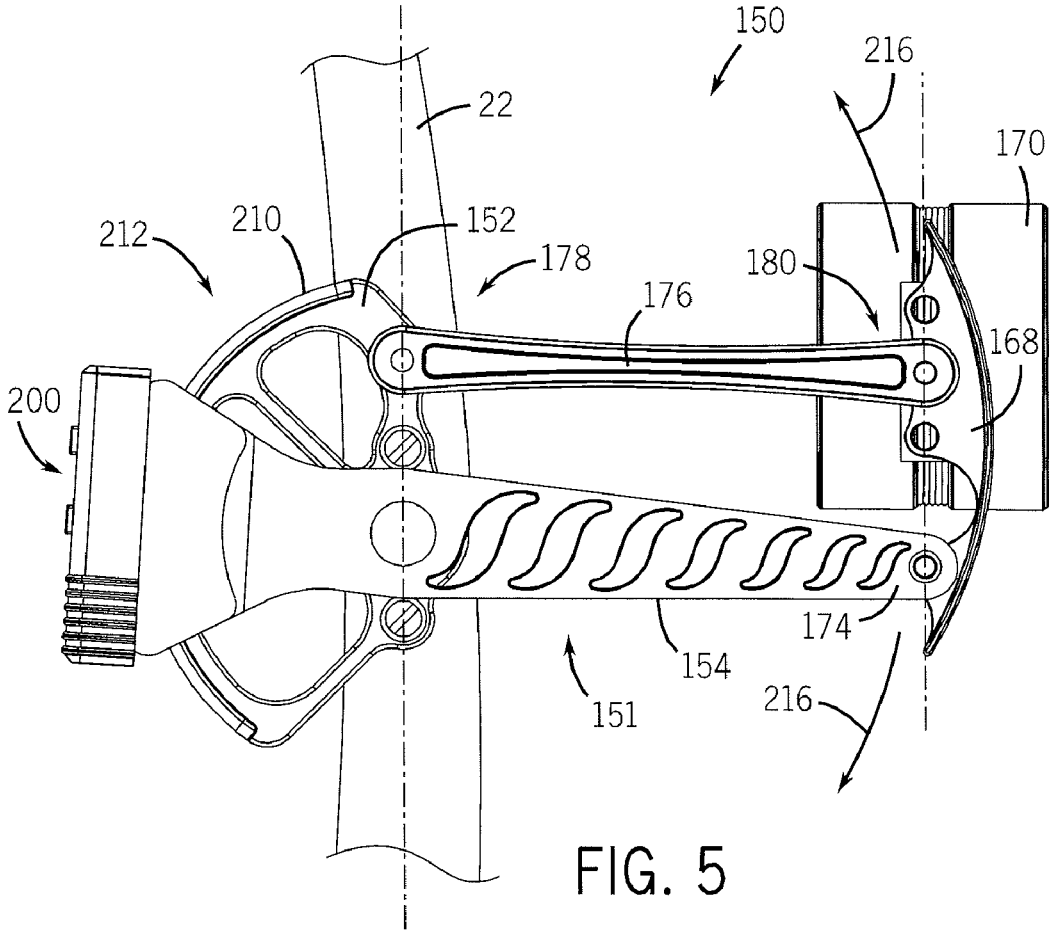
FIG. 5 is an elevation view of a bow sight according to another embodiment of the invention.
Figure 6:
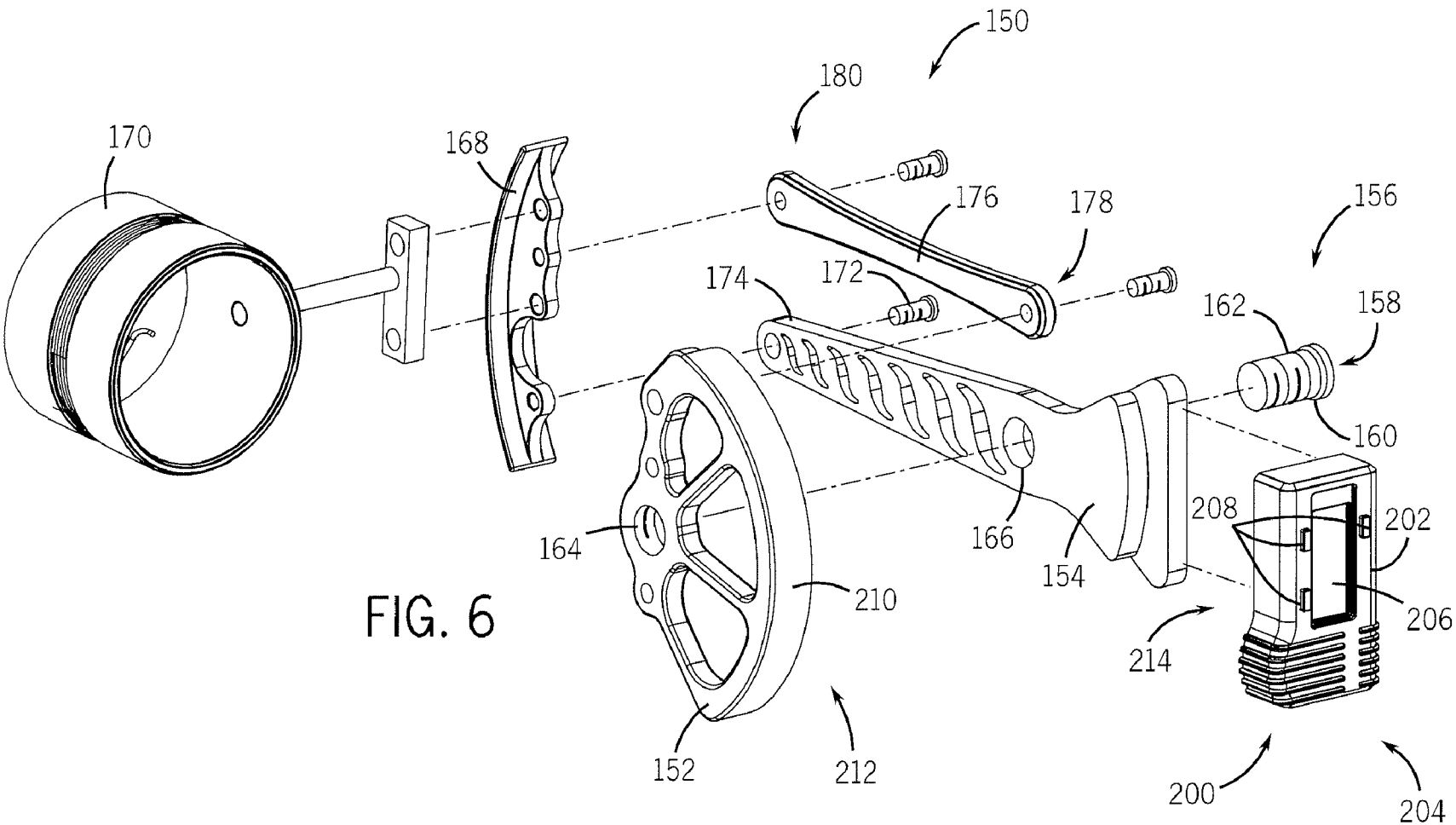
FIG. 6 is an exploded view of the bow sight shown in FIG. 5.

FIGS. 5 and 6 show other embodiment of an archery sight 150 according to the present invention. Sight 150 includes an adjustment mechanism 151 that has a first member, first link, or base member 152 constructed to be secured to riser 22 of bow 10. A second link or second member 154 is secured to first member 152 and is constructed to pivot about a pivot pin 156. Pivot pin 156 includes a head portion 158 a pivot portion 160 and a threaded portion 162. Threaded portion 162 is constructed to operatively engage a threaded opening 164 formed in first member 152. An opening 166 formed in second member 154 is constructed to be engaged with pivot portion 160 of pin 156 such that second member 154 can rotate or pivot about an axis of pin 156.

A third link, third member, or ring mount 168 has an ocular, sight ring, or eyepiece 170 secured thereto. Eyepiece 170 is generally similar to eyepiece 76. A pivot 172 secures an end 174 of second member 154 to ring mount 168. Pivot 172 is constructed to allow relative rotation between ring mount 168 and second member 154. A fourth member or intermediary link 176 includes a first end 178 that is pivotably secured to first member 152 and a second end 180 that is pivotably secured to ring mount 168.

A positioning system 200 is fixedly secured to second member 154. Positioning system 200 includes a housing 202 constructed to generally enclose a controller 204 and a display 206. A number of inputs 208 are accessible through housing 202 and configured to allow an operator to interact with controller 204. The operation and user interaction with controller 204 is generally similar to that described above with respect to controllers 104, 134. A stator 210 is affixed to an outer curved surface 212 of base member 152. Controller 204 includes a slide 214 configured to overhang stator 210 such that rotation of second member 154 relative to base member 152 results in translation of slide 214 relative to stator 210. Understandably, the construction of the members of positioning system 200 allows the positioning system to have a curved as well as straight configuration. Such a construction allows controller 204 to electronically determine and output an indication of the relative position of second member 154 and base member 152. As eyepiece 170 moves with second member 154, controller 204 also indicates a position of eyepiece 170 relative to riser 22. Understandably, such an indication is preferably output in the format of a distance value to an intended target.

The pivotable connections between base member 152, second member 154, and ring mount 168 provides for translation of eyepiece 170 upon movement of second member 154 relative to riser 22. Referring to FIG. 5, the pivotable connection of ring mount 168 to riser 22 via generally parallel second member 154 and intermediary link 176 ensures that eyepiece 170 moves about a curve, indicated by line 216, that is centered about a shooter's eye. Such a construction ensures that eyepiece 170 is oriented generally normal to the sight path 40 of archer 34 throughout the range of motion of eyepiece 170. Such an orientation of eyepiece 170 relative to the shooter's eye is particularly beneficial when eyepiece 170 is configured as a magnification lens and also maintains the line of sight to the target concentric through the eyepiece. Accordingly, sight 150 also provides a bow sight that is highly adjustable, easy to use, electronically assesses the orientation of the eyepiece relative to the bow, and provides a high degree of sight pin position repeatability.

It is further envisioned that each of the sights above relatively seamlessly integrate with other archery accessories. That is, the electronic assessment of the position of the sight device relative to the bow could include electronic range finding abilities such that the sights can proactively assess the distance to a target. It is also envisioned that the sights include a drive assembly to automatically manipulate the position of the sight relative to the bow. Such a configuration would preferably include a closed feedback system thereby allowing the sight to auto position the eyepiece relative to the bow for any of a number of given configurations. These accoutrements would further enhance the automatic assessment of target acquisition and sight orientation thereby providing an even more efficient and repeatable sight to target orientating system.

Therefore, an archery sight according to one embodiment of the invention includes a body for engaging a bow. The sight includes an ocular for being disposed between an archer and a target and an adjustment mechanism for adjusting a position of the ocular relative to the body. A digital display outputs an indication of a distance between the archer and the target.

A bow sight according to another embodiment of the invention includes a support body and an eyepiece movably attached to the support body. The sight includes a positioning system configured to electronically determine the position of the eyepiece relative to the support body.

A method of providing an archery sight according to a further embodiment of the invention includes providing a body constructed to be secured to a bow. An operator is attached to the body such that the operator is movable relative to the body. The method electronically determines a relative position of the operator and the body.

An archery sight according to another embodiment of the invention includes a number of interconnected members. The sight has a first member for being attached to a bow and a second member pivotably attached to the first member. A third member is pivotably attached to the second member remote from the first member and has a scope ring attached thereto. A fourth member is pivotably attached to the first and third members and offset from the second member.

Various other embodiments of the present invention are considered within the scope of the following claims which particularly point out and distinctly claim the subject matter regarded as the invention.

What is claimed is:

1. An archery sight comprising:

a first member for being attached to a bow;

a second member pivotably attached to the first member;

a third member pivotably attached to the second member remote from the first member and having a scope ring attached thereto; and a fourth member pivotably attached to the first member and the third member and offset from the second member.

2. The archery sight of claim 1 further comprising a yardage indicator attached to the second member and constructed to electronically determine a position of the scope ring relative to the first member.

3. The archery sight of claim 1 further comprising a controller configured to store at least one position value.

4. The archery sight of claim 2 wherein the yardage indicator includes a controller configured to proactively determine at least one yardage value.

* * * * *